US006283898B1

(12) United States Patent
Polidi

(10) Patent No.: US 6,283,898 B1
(45) **Date of Patent: *Sep. 4, 2001**

(54) MECHANICAL WEIGHTLIFTING MACHINE

(76) Inventor: Richard Zachary Polidi, 170 W. End Ave., New York, NY (US) 10023

( * ) Notice: Subject to any disclaimer, the term of this patent is extended or adjusted under 35 U.S.C. 154(b) by 0 days.

This patent is subject to a terminal disclaimer.

(21) Appl. No.: 09/277,806

(22) Filed: Mar. 27, 1999

Related U.S. Application Data

(63) Continuation-in-part of application No. 09/128,167, filed on Aug. 3, 1998, now abandoned, which is a continuation-in-part of application No. 08/905,461, filed on Aug. 4, 1997, now Pat. No. 5,788,616.

(51) Int. Cl.[7] ..... A63B 21/078
(52) U.S. Cl. ..... 482/104; 482/94; 482/97
(58) Field of Search ..... 482/93, 94, 97, 482/104, 106, 108

(56) References Cited

U.S. PATENT DOCUMENTS 5,411,459 * 5/1995 Hayden ..... 482/104

* cited by examiner

*Primary Examiner*—John Mulcahy

(57) ABSTRACT

A mechanical weightlifting machine in which the machine has a support structure with an elevated pivot having a pivot axis and an articulating mechanism engaging the pivot. The articulating mechanism having at least one articulating structure with a lever arm that has a depending link connected to the weight being used by the weightlifter. The articulating structure having an adjustment mechanism with a displaceable connection device connected to a counterweight. The adjustment mechanism having means for moving the displaceable connection device relative to the pivot axis and actuation means for actuating the means for moving, in order to vary the effective weight removed from or applied to the weight being used by the weightlifter.

20 Claims, 11 Drawing Sheets

FIG. 3
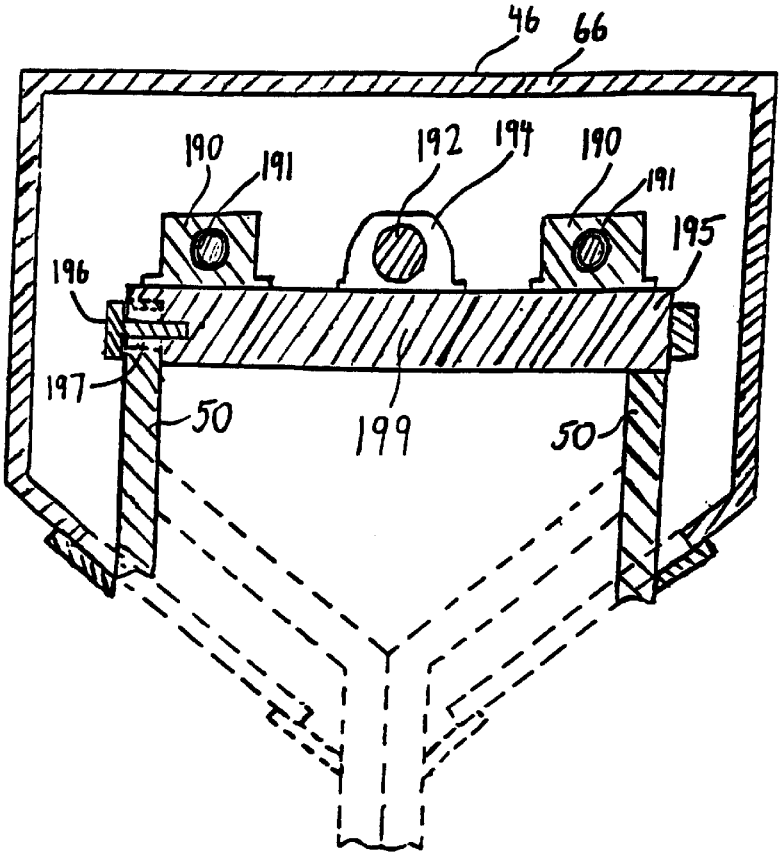
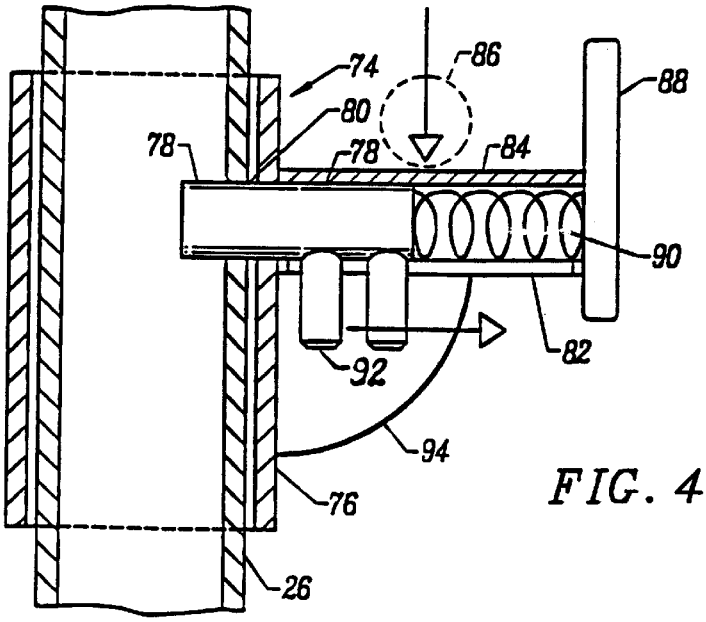
FIG. 4

MECHANICAL WEIGHTLIFTING MACHINE

RELATED APPLICATIONS

This application is a Continuation-In-Part of U.S. application Ser. No. 09/128,167 filed Aug. 3, 1998, now abandoned, which is a Continuation-In-Part of U.S. application Ser. No. 08/905,461 filed Aug. 4, 1997, which issued as U.S. Pat. No. 5,788,616 on Aug. 4, 1998.

FIELD OF THE INVENTION

This invention relates to a machine used in weightlifting exercises.

BACKGROUND OF THE INVENTION

A weightlifter can benefit from the active involvement of a second person, commonly known as a spotter, during a weightlifting routine. This spotter serves two basic functions. The first is to prevent injury to the weightlifter. The second is to prolong the weightlifting exercise by providing aid to the weightlifter during the weightlifting repetitions. The second function allows the weightlifter to complete additional repetitions after his or her muscles have begun to fatigue. Completing repetitions with slightly fatigued muscles can help the weightlifter improve muscle stamina and increase muscle mass.

Many weightlifters face the drawback of not having skilled spotters to help them on a consistent basis. As a result, these weightlifters sometimes do not achieve the results they seek and grow disheartened with the sport. In response, weightlifting facilities staff trainers to whom all weightlifters have equal access. Unfortunately, it is impossible for only a few trainers to provide the services of a spotter to all these weightlifters at any one time.

In response to this drawback, inventors have designed user-controlled and microprocessor-controlled machines to serve both basic functions of a spotter. Most of these machines rely either on an electric motor to lift the weight or on a pneumatic device to vary the assistance to the exerciser, both in response to some form of an input from the exerciser.

A shortcoming of these machines is that they usually use cables. Unless the cables are continuously taut throughout the exercise, they can move suddenly, interfering with the exerciser's motion and causing discomfort.

Several of these machines also are not versatile enough to perform all the functions of a spotter. In particular, a machine that uses a motor to pull up a weight can not perform several certain functions of a spotter. A spotter can provide different amounts of assistance at different points in the exercise by applying different forces to the weight, while the exerciser applies the remainder of the force needed to counter gravity. Not until the very end of the exercise, if ever, does a spotter lift the weight out of the exerciser's hands. In theory, a motor can apply different forces as long as the voltage drop or the current across it can be varied. But in application, activating a motor turns a rotor, in turn (possibly through a transmission) lifting the weight on its own.

Machines with pneumatic devices unfortunately may require several seconds to vary the amount of assistance given to the exerciser, whereas a human spotter is able to provide the assistance immediately.

SUMMARY OF THE INVENTION

The object of the invention is to provide an apparatus that can perform the functions of a spotter with comfort, precision, and consistency. Therefore, a first objective is to be able to function without using cables. A second objective is to be able to apply various different forces to the exerciser's weight throughout a single routine, possibly including a force great enough to raise the weight without assistance from the exerciser. A third objective is to be able to vary this assistance quickly. A fourth objective is to be able to function without restricting the exerciser's range of motion. A fifth objective is to function in a manner that safe and visible.

The mechanical weightlifting machine of the invention comprises a support structure with an elevated pivot having a pivot axis. An articulating mechanism engaging the pivot has at least one articulating structure, and each the articulating structure has at least one lever arm. Each lever arm has a distal end on one side of the pivot with a connection device from which a depending link member is suspended. The depending link member has and end with means for engaging the bar of a weight. The articulating structure has an adjustment mechanism with a displaceable connection device with a counterweight that has an effective connection point locatable on the opposite side of the pivot. The adjustment mechanism has means for moving the displaceable connection device and thus the effective connection point relative to the axis of the pivot, wherein the leverage of the counterweight directed to the lever arm is adjusted. Actuation means can actuate the means for moving the displaceable connection device. A control device remote from the adjustment mechanism has control means for controlling the actuation means.

BRIEF DESCRIPTION OF THE DRAWINGS

For a complete understanding of the above and other features of the invention, reference is made to the following detailed description and the accompanying drawings, wherein:

FIG. 3 is an enlarged cross sectional view taken on the line 3.3 in FIG. 2.

FIG. 4 is an enlarged cross sectional view of a weight rest on the weightlifting machine of FIG. 1.

DETAILED DESCRIPTION OF THE PREFERRED EMBODIMENTS

Figure 1:
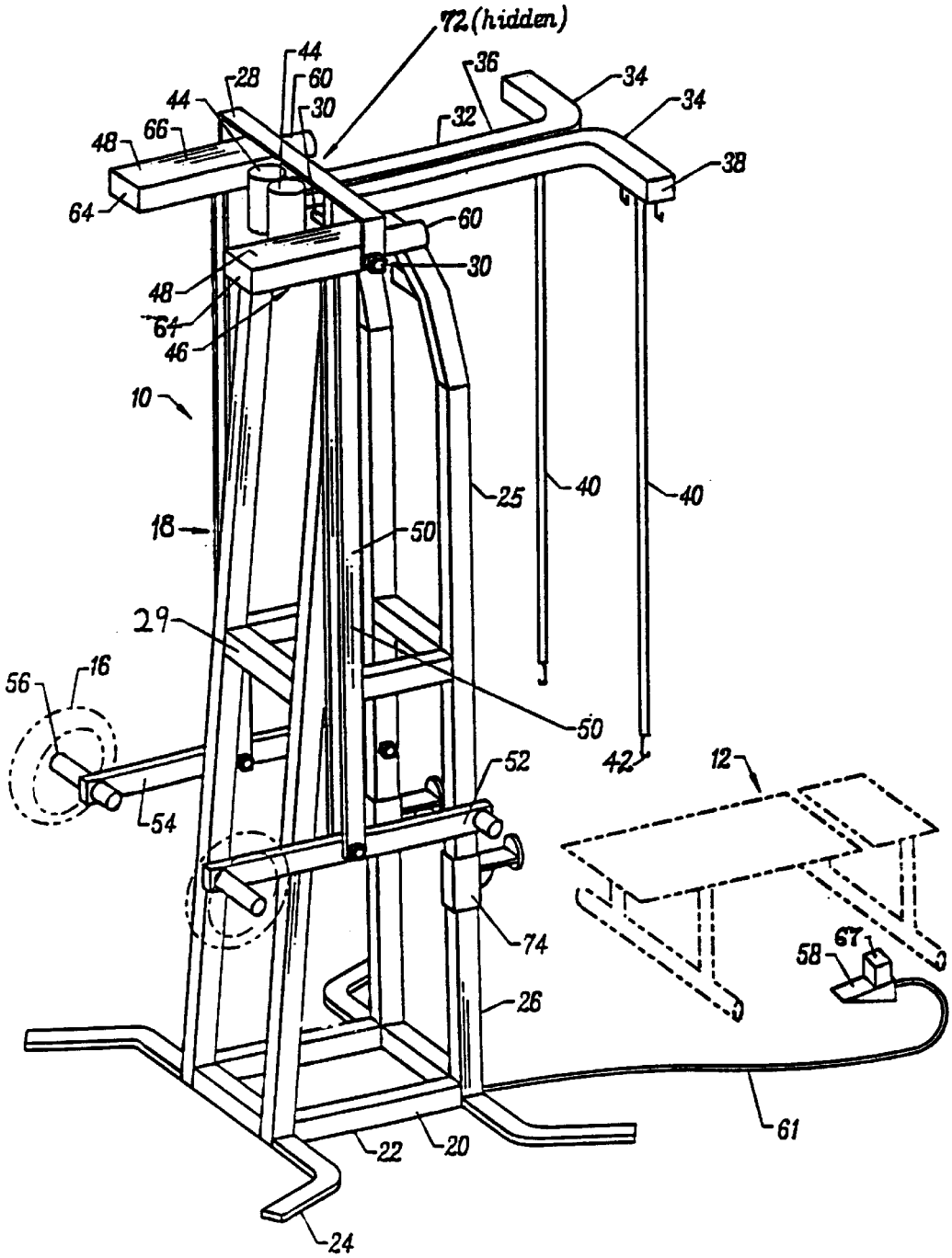
FIG. 1 is a perspective view of the weightlifting machine.

The mechanical weightlifting machine of this invention, designated generally by the reference numeral 10, functions as a mechanical spotter. The mechanical weightlifting machine 10, hereinafter the spotter, is used in many routines with a conventional bench 12 shown in phantom in FIG. 1. The spotter can also accommodate inclining and declining benches, upright seats, and a standing exerciser without any bench. The spotter is used with weights in the form of conventional plates or disks 16, two of which are shown in phantom in FIG. 1.

The spotter 10 is constructed with a support frame 18 having a base 20 formed by interconnected box tube members 22 and wing-like stabilizer members 24. The support frame 18 has a vertical support structure 25 formed of substantially vertical box tube members 26 having a generally rectangular or pyramidal structure with an apex cross beam 28. Box tube members 29 located approximately midway on the vertical support 24 provide the necessary bracing to impart rigidity to the support frame for the range of uses and weights for which the apparatus was contemplated. The box tube members are joined by welding or bolting and are customarily powder coated for appearance and protection.

The cross beam 28 supports a pivot shaft 30 to which an articulating structure 34 is attached for pivotal movement. The articulating mechanism 32 preferably has two independently articulating structures 34 to allow the mechanical spotter 10 to be used either with a barbell or with dumbbells while only minimally restricting the exerciser's range of motion. Each articulating structure 34 has a projecting lever arm 36 as well as an adjustment mechanism 46. Each articulating structure 34 can be used alone without the operation of the other structure. Therefore, a spotter whose articulating mechanism 32 consists of a single articulating structure 34 may be suitable for a weightlifter who exercises either with a barbell or with one dumbbell at a time. However, it is preferred that the articulating mechanism 32 have two independently articulating structures 34 for use either with a barbell or with two dumbbells simultaneously.

Each articulating structure 34 has a cantilever arm 36 with a distal end 38. As shown in FIG. 1, each cantilever arm 36 has a right angle to provide the appropriate spacing between the distal ends 38 of the articulating structures 34. Alternately, each cantilever arm 36 may be straight, and the cantilever arms 36 or the entire articulating structures 34 may be spaced apart from each other to provide the appropriate spacing at the distal ends 38. In addition, the straight cantilever arms could be positioned so they are slightly out of parallel with each other when viewed from above, so that each arm articulates about a slightly different pivot axis.

Figure 7:
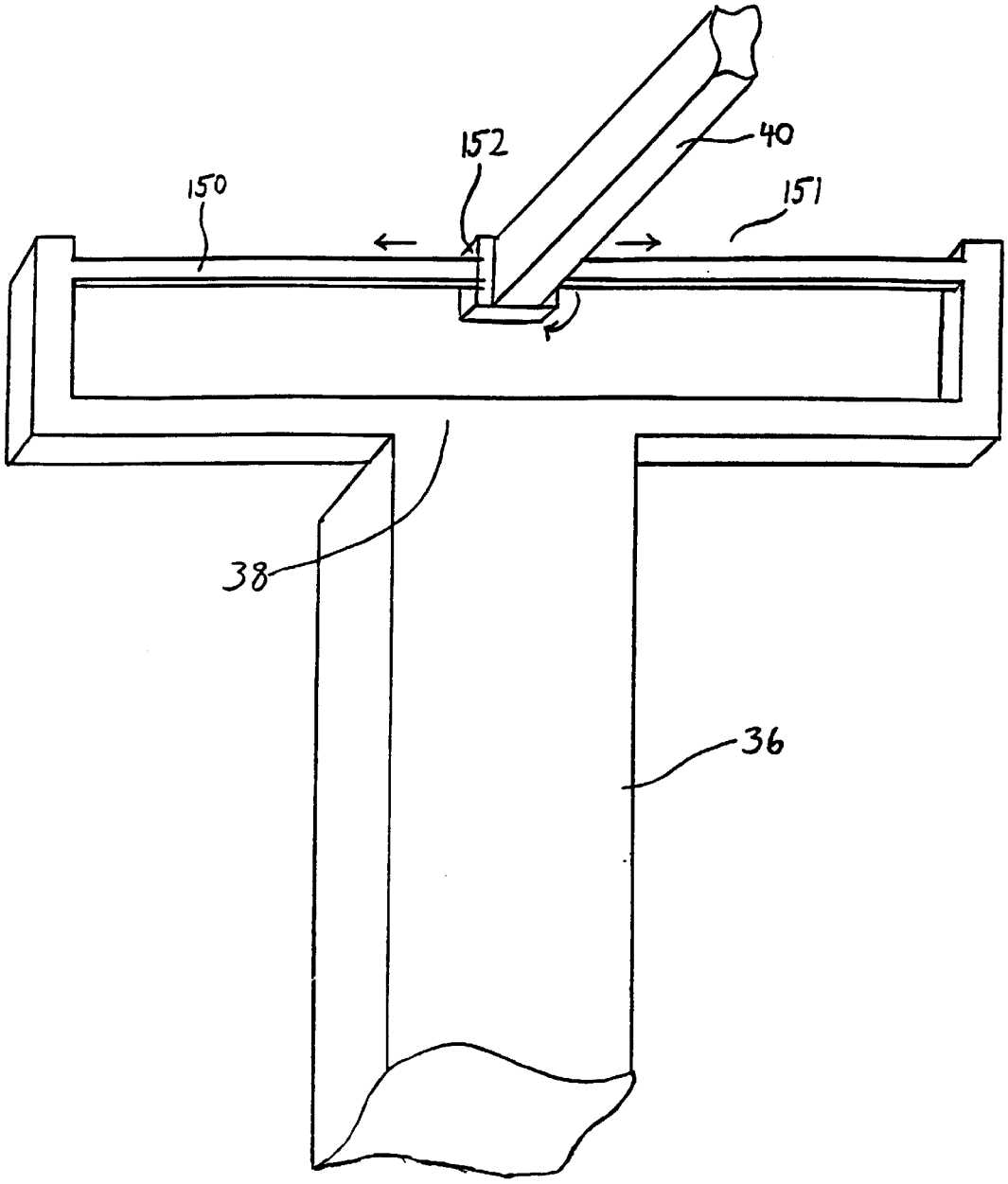
FIG. 7 is a bottom view of an alternate means for suspending a rod from the distal end of a lever arm of the weightlifting machine.

From the distal ends 38 are suspended rods 40 with ends 42 that have means for engaging a bar (for example, a bar of a barbell or dumbbell). Each rod 40 is suspended from a distal end 38 by way of a connection device, such as a universal joint. Each rod 40 may also be suspended from a distal end 38 by way of the apparatus 151 shown in FIG. 7. In FIG. 7, the rod 40 is attached at the distal end 38 of the cantilever arm 36 by a carriage 152 that can both rotate about and slide along a shaft 150. If the rod 40 is fixed to the carriage 152, then the rod 40 is always perpendicular to the shaft 150.

Figure 8:
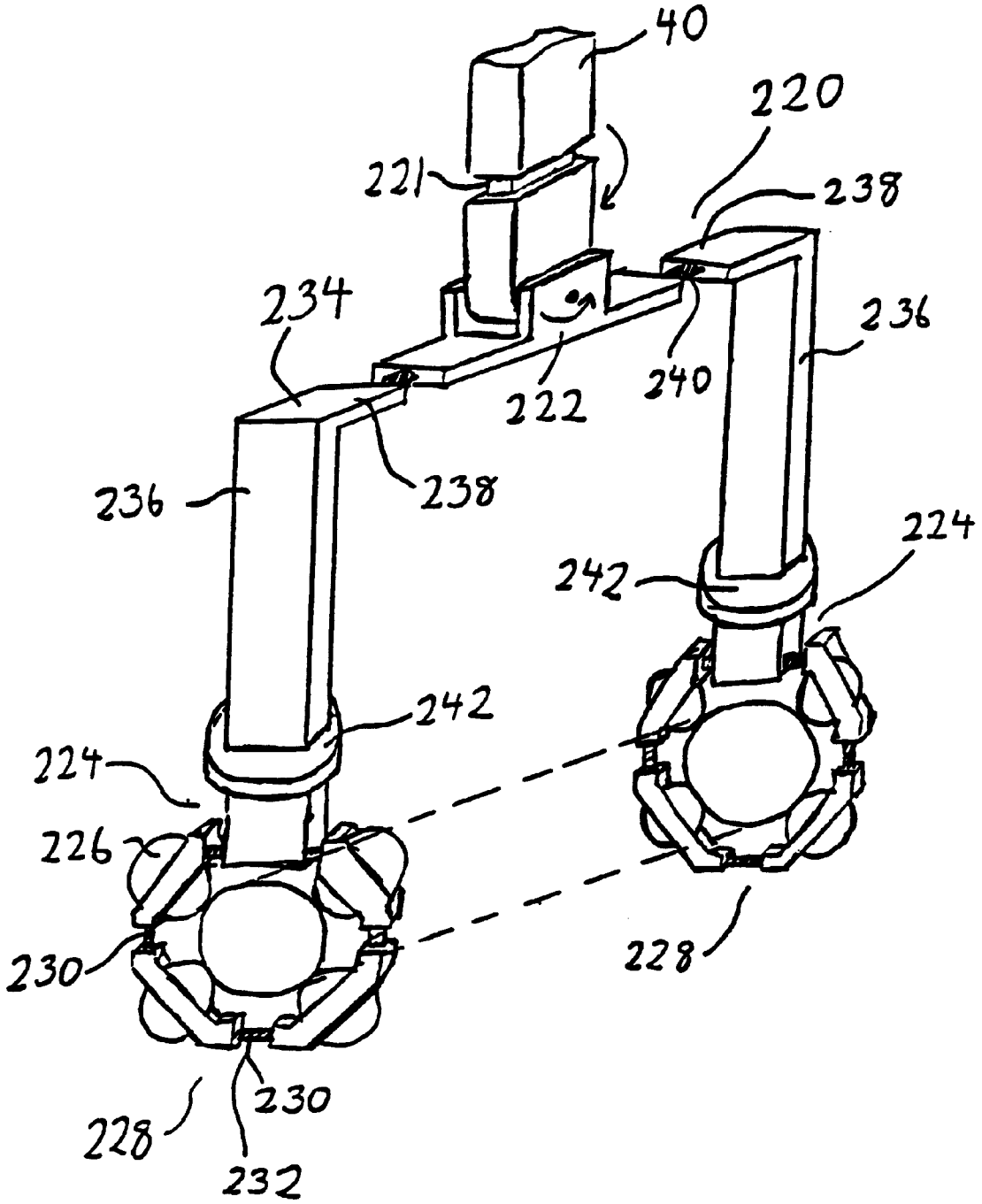
FIG. 8 is a perspective view of an apparatus that connects a weight to the weightlifting machine of FIG. 1.

The means for engaging a bar at the rod ends 42 may comprise hooks, clasps, grooves, or collars. Preferably, the means for engaging do not restrict the natural range of motion of the weight as experienced by the exerciser, or any restriction that results is only slight. Alternately, the means for engaging may include the more elaborate structure shown in FIGS. 8, 9, and 10. As shown in FIG. 8, connected by pivoting joints 221 and 222 to each rod 40 is an apparatus 220 that attaches to the bar (shown in phantom). This apparatus 220 is designed not to restrict any of the degrees of freedom or range of motion of the weight as experienced by the weightlifter. The weight is able to move, twist, turn, and rotate essentially as though it was not connected to the spotter. The apparatus 220 is designed to adapt to all thickness and lengths of bars that a weightlifter might use. Also, the apparatus 220 is designed not to interfere with the hands of the weightlifter.

The apparatus has at least one end 224, although the one shown in FIG. 8 has two ends 224. Each end 224 has at least three wheels 226, while each end shown in FIG. 8 has four wheels 226. The wheels 226 can have ribs to grip the bar more securely. The wheels 226 are positioned relative to one another to create a generally symmetric polygonal shape 228. Several sides 230 of this shape 228 have adjustable lengths. To allow adjustment, the sides 228 incorporate the threaded rods 232. Alternately, the sides might incorporate springs (not shown) that cause the polygonal shape 228 to hug the bar.

Connected to a side 230 or a vertex of each of the preferably two polygonal shapes 228 is an upside-down U-shaped member 234 designed to connect the shapes 228 to each other while simultaneously not interfering with a weightlifter's hands. This member 234 has two sides 236 and a cross-support 238. The length of the cross-support 238 is adjustable, here by threaded rods 240, to provide a better fit for each user's hands. Each side 236 can incorporate a wheel 242 for rolling along the inside of a dumbbell endplate in order to hold the dumbbell more securely on the apparatus 220.

Figure 9:
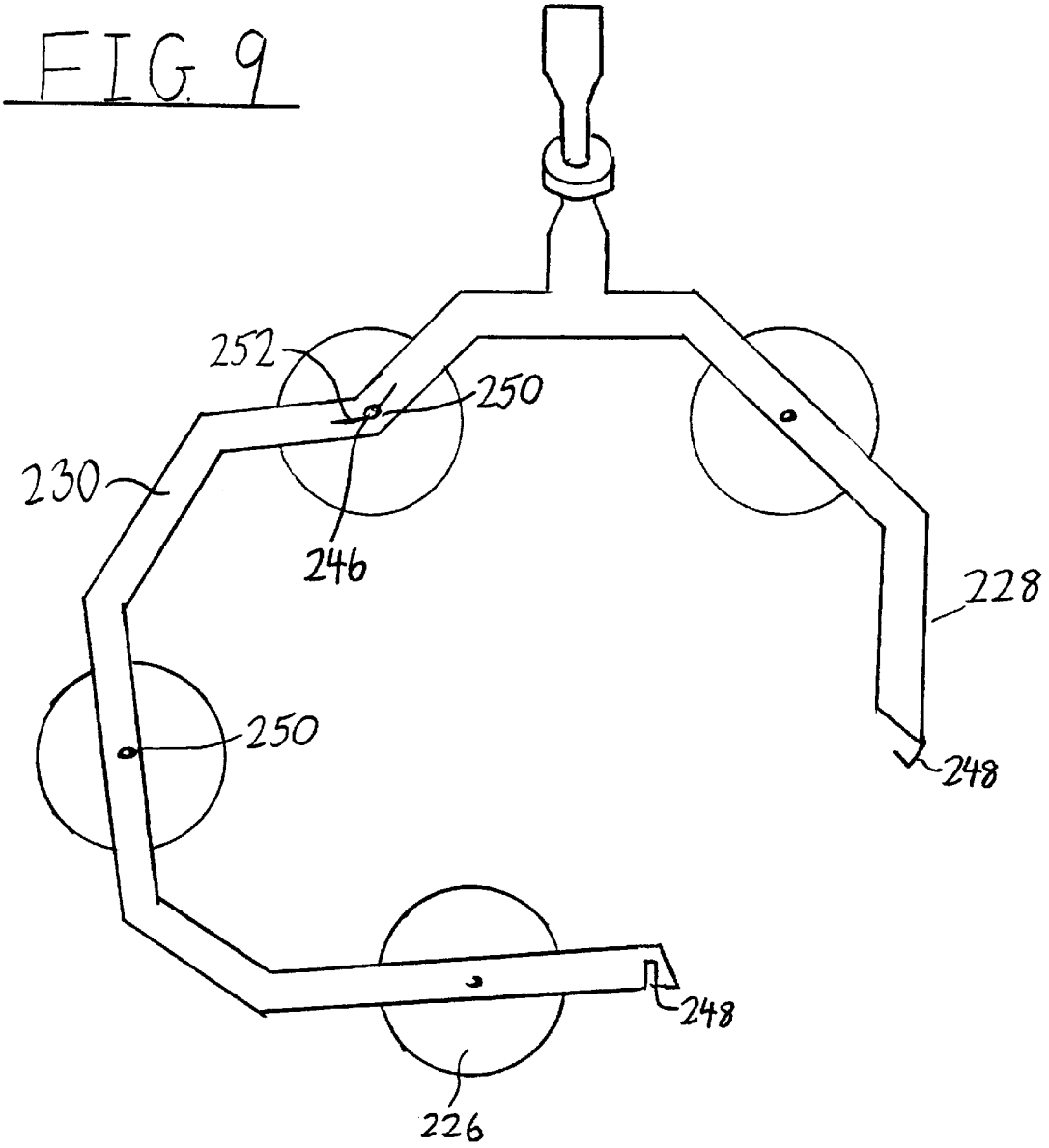
FIG. 9 is a side view of one half of the apparatus in FIG. 8, in an open position.

As shown in FIG. 9, each polygon 228 has a hinge 246 and a latch 248 for opening and shutting around the bar. The hinge 246 can be located at either a vertex 250 or a side 230 of each polygon 228. The hinge 246 can also have a torsional spring 252 to bias the polygon 228 in an open or shut position.

Figure 10:
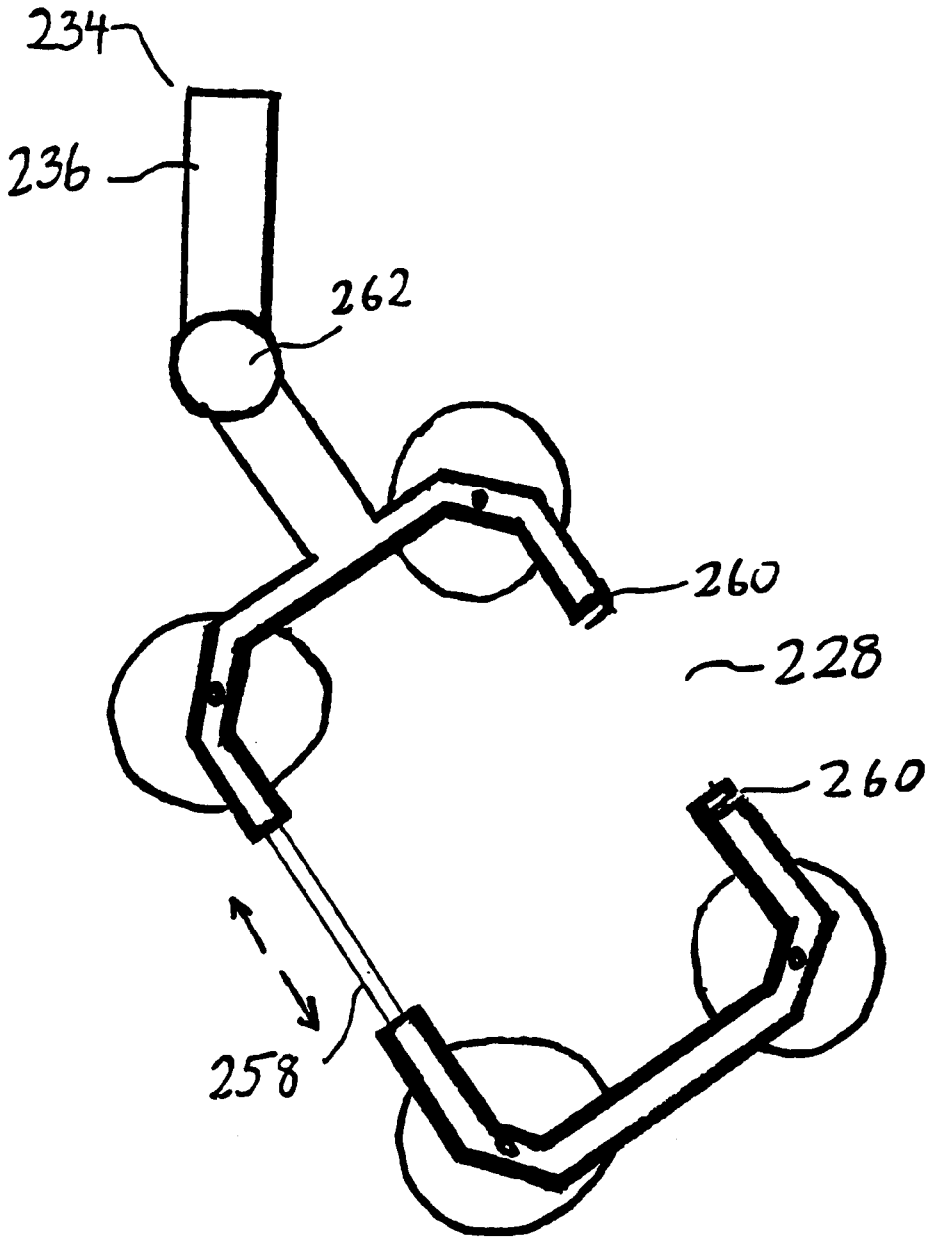
FIG. 10 is a side view of one half of the apparatus in FIG. 8 in a differently opened position, and with one side of its bracing angularly displaced from an in-line position.

As shown in FIG. 10, the polygon 228 can alternately be built to open and shut by lengthening and shortening one of its sides 258. A latch 260 would brace the polygon 228 in a shut position. Also, each side 236 of the upside-down U-shaped member 234 can have a pivoting joint 262 to allow it to be displaced angularly from a straight position to add comfort to the weightlifter while performing certain exercises. The upside-down U-shaped member 234, usually made either of a metal such as aluminum or of a hard plastic, can have a soft shell (such as a rubber one) for protection as well as for added comfort.

Figure 11:
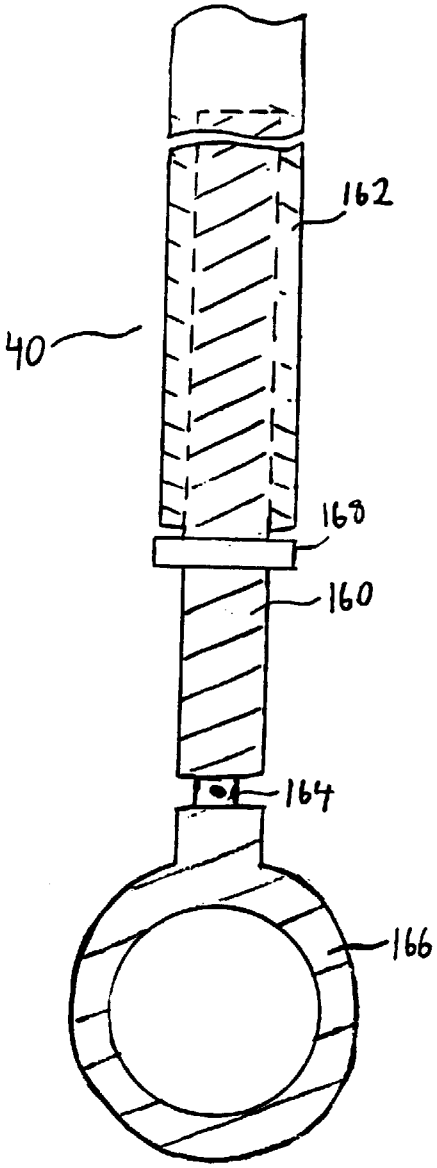
FIG. 11 is a side view of a first embodiment of the adjustable rod suspended from the distal end of a lever arm.
Figure 12:
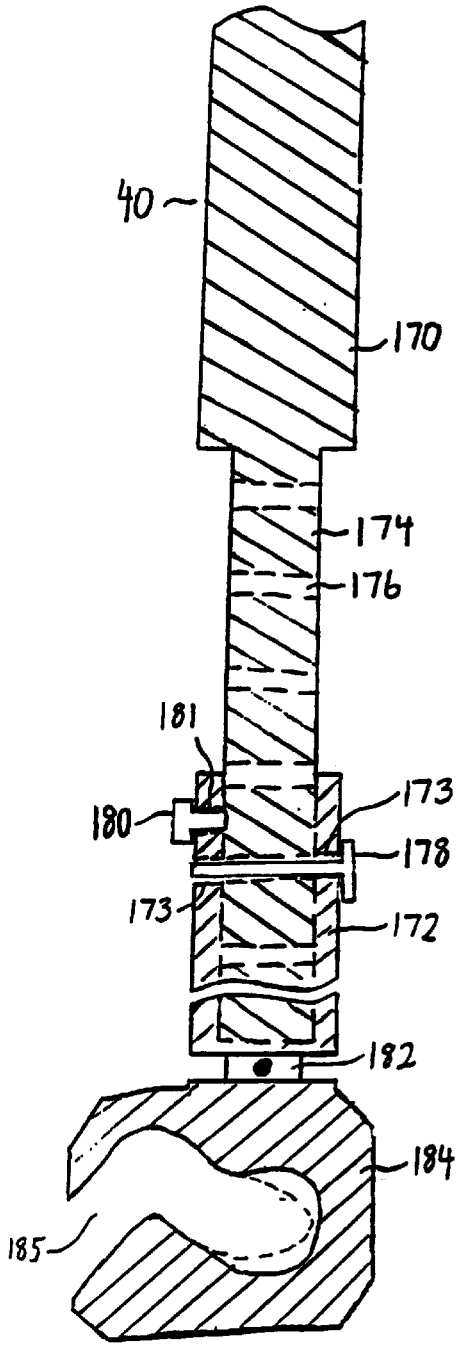
FIG. 12 is a side view of a second embodiment of the adjustable rod suspended from the distal end of a lever arm.

As shown in FIGS. 11 and 12, the rods 40 may have alternate embodiments. Preferably, the rods 40 are adjustable in length to allow a weightlifter to use a flat bench, an inclining or declining bench, a seat, or to stand while using the spotter. If the lengths of the rods 40 are adjusted properly, the cantilever arms 36 should rise approximately 30° from the horizontal and lower approximately 30° from the horizontal during exercise repetitions. This provides roughly a 30 inch displacement at the distal ends 38 of the arms 36. Two possible embodiments of the adjustable rods are shown in FIGS. 11 and 12.

In FIG. 11, the rod 40 has an inner section 160 that threadably engages an outer section 162. Twisting the inner section 160 relative to the outer section 162 results in changing the overall length of the rod 40. The inner section 160 also engages a nut 168 that can be tightened up against the outer section 162 for the purpose of locking these two sections relative to each other. A universal joint 164 which connects the inner section 160 to a collar 166 allows this collar to move freely about the longitudinal axis of the inner section 160 as well as about any axis perpendicular to the longitudinal axis. This collar is one possible means for engaging the bar of a barbell or dumbbell.

In FIG. 12, the rod 40 has a thicker section 170 and a narrower section 174. The narrower section 174 is inserted into a hollow tube 172 for linear movement therealong. The narrower section has apertures 176 that can align with other apertures 173 in the hollow tube 172. A pin 178 that can selectively align these apertures together secures the hollow tube 172 in place along the rod 40. A screw 180 that threadably engages a hole 181 in the hollow tube 172 presses against the narrower section 174 to help in secure the hollow tube in place. A universal joint 182 similar to the joint 164 connects the hollow tube 172 to a plate 184 with a groove 185 into which the bar of a barbell or a dumbbell may be inserted. This groove can narrow at the end, as shown in phantom, in order to accommodate bars with various diameters.

The arms 36 extend a short distance beyond the pivot shaft 30 and are connected to counter weights 44. The size of each counter weight 44 makes the user experience no additional force upon the exercise weights aside from the force of the weights themselves, until the user so desires.

The arms 36 of the articulating structures 34 are fixed to the shaft 30 so that rotation of the shaft by the arms 36 also rotates a connected adjustment mechanism 46 with a lever arm 48 having an adjustable effective length. The spotter can be reset before a weightlifting routine to make the effective length of this lever arm 48 equal to zero. Then, a rise in the effective length would create an upward force at the rods 40, effectively varying the weight removed from the weight being used by the exerciser.

Each lever arm 48 is connected by an elongated vertical link 50 to another lever arm 52 with a distal end 54 equipped with a weight spindle 56 for the optional addition of weight plates 16. The weight spindle 56 provides for placement of one or more weights 16 to increase the rate of weight adjustment as the effective length of the lever arm 48 changes, and to increase the maximum assistance provided when the effective length of the lever arm 48 is at its maximum. It is also possible to provide an adjustment at the intersection of the vertical link 50 and the lever arm 52 that allows this point of intersection to vary along the length of the lever arm 52. This adjustment would affect the leverage of the lever arm 52 and of any additional weight plates 16 upon the vertical link 50, and in turn upon the lever arm 48.

A foot control 58 is electronically connected to a pair of drive motors 60 either by a cord or by a cordless signal. The motors 60 have control means that comprise an electronic controller circuitry associated with the electric motors 60 for controlling the motors in response to control signals from the foot control 58. The control means have displacement means for displacing the motors by specified amounts in response to control signals. Once the motors are displaced, the control means are able to prevent the motors from turning unless a control signal triggers another displacement. For example, the controls means may include devices such as a limit switch and an electronic brake; alternately, the drive motors 60 may be servomotors. Activating the motors results in changing the effective length of the lever arms 48 within the adjustment mechanisms 46. It is possible to build the adjustment mechanism without motors, so that the mechanical force from pressing on a pedal is translated into a rotational force upon the ball screw. However, the spotter should be more user-friendly with electric control means than otherwise with mechanical control means.

The foot control 58 has a toe strap 67 to permit bi-directional control of the motor. For example, a lift action by the user's foot might shorten the effective length of the lever arm 48 while a down pressure might increase it. The foot control 58 might also come equipped with a reset that returns the effective length of each lever arm 48 to zero.

Figure 13:
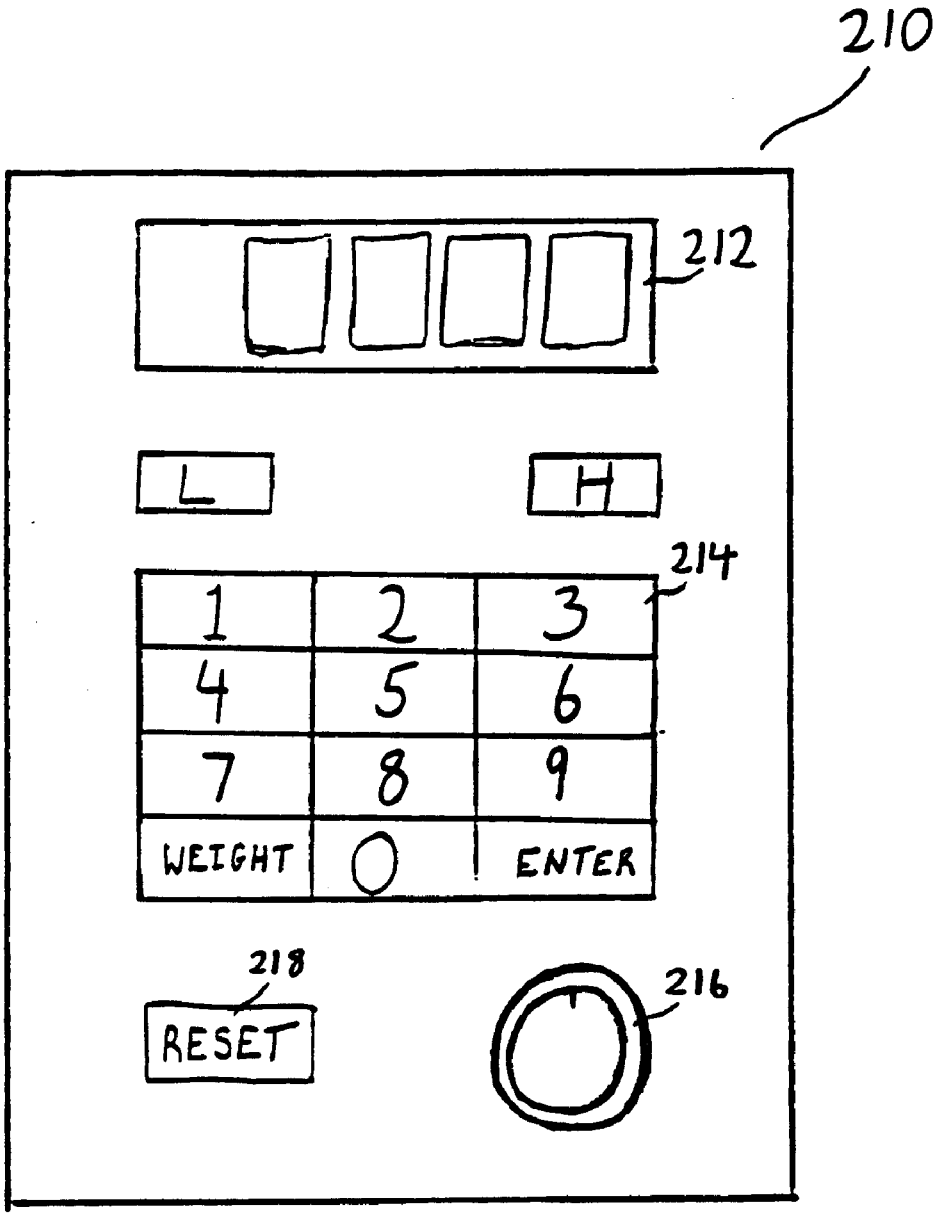
FIG. 13 is a schematic view of a hand control device that can be used by someone other than the weightlifter.

The foot control 58 may be replaced by a head control (not shown) or by a hand control. The hand control may be designed for the weightlifter to activate (not shown) or may be designed for use by a trainer or someone else overseeing the weightlifter's regimen. The latter is particularly suited for a physical therapy facility where a trainer wishes to have precise control over the resistance of the weight. As shown in FIG. 13, the hand dial 210 has a digital display 212 and a numeric keypad 214 for entering the amount of weight placed onto the spotter. Buttons labeled "H" and "L" increase and decrease the amount of assistance, respectively. A rotary dial 216 allows for a fine adjustment of the amount of assistance. A reset button 218 resets the adjustment mechanisms to their original positions.

Figure 2:
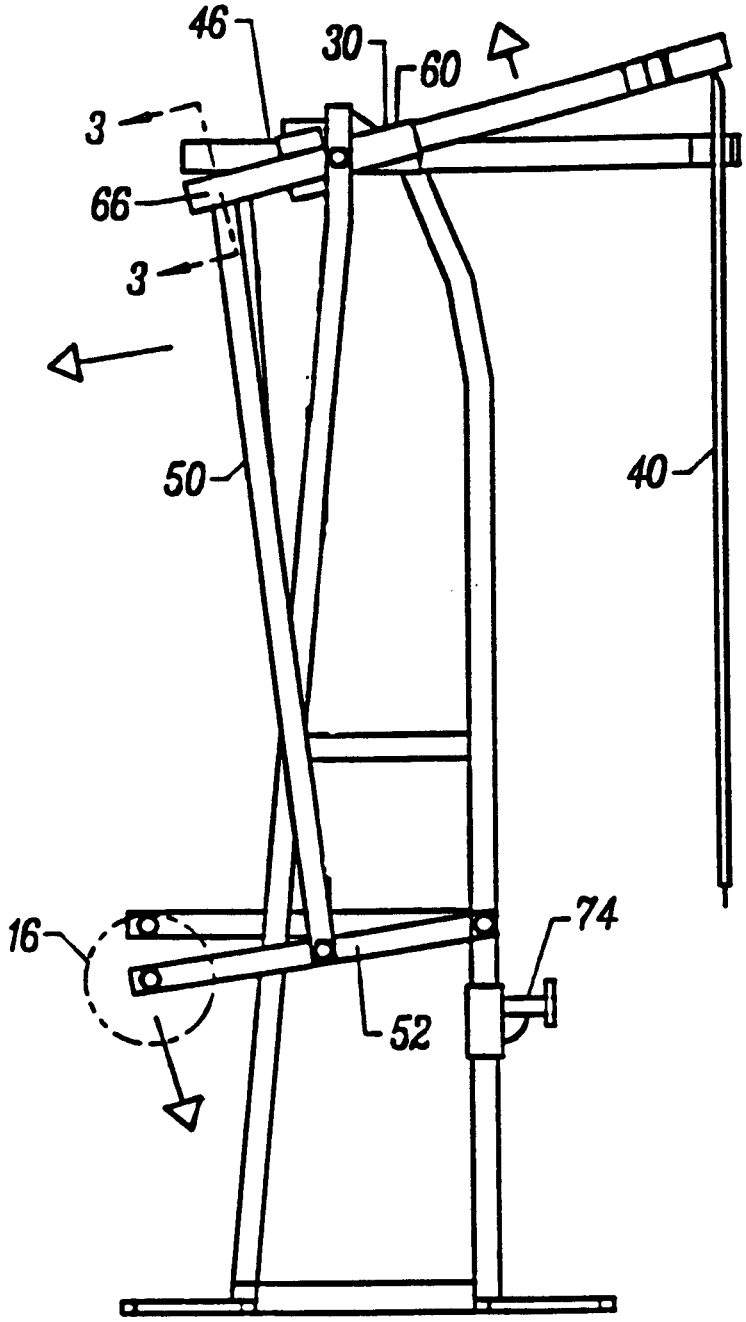
FIG. 2 is a side elevation view of the weightlifting machine of FIG. 1 with one arm displaced from the other.

As shown in FIGS. 2 and 3, the elongated links 50 have a point of effective connection to the carriage 195 where screws 196 fasten the links 50 to the carriage 195 through bearings 197. The adjustment mechanism 46 when activated displaces this effective connection point from a position proximate the axis of the pivot shaft 30 to a position displaced from the shaft 30 with the effect of changing the effective length of the lever arm 48. For example, in FIG. 2, the effective connection point within each adjustment mechanism 46 is moved toward the distal end of the shroud 66. FIG. 3 shows one embodiment of the displaceable connection device 199. In FIG. 3, the adjustment mechanism 46 includes an outer shroud 66 that forms a housing for two shafts 191 that guide the displaceable connection device 199 by way of linear bearings 190. The carriage portion 195 of the displaceable connection device 199 is displaced by means for moving it, here for example comprising a ball screw 192 that engages a nut 194 fastened to the carriage 195, where the screw 192 is actuated by a drive motor 60. An alternate embodiment of the links 50 is shown in phantom in FIG. 3, where the two links join to form a single link. When the links 50 are displaced from a position proximate the axis of the pivot shaft 30, the effect is to translate the generally downward force, including the force from the counterweight of the displaceable connection device 199 as well as from the separate counterweights 16, into a generally upward force at the rods 40.

The spotter can also effectively add weight to the weight being used by the exerciser. If the adjustment mechanism 46 is extended past the pivot shaft 30 in the direction of the distal end 38 of the cantilever arm 36, then positioning the effective connection point on this side of the pivot shaft 30 has the effect of translating the generally downward force from the weights 16 into a generally downward force at the rods 40.

To limit the downward swing of the arms 36, the support frame 18 is equipped with stops 72 that can prevent a downward angle exceeding, for example, 45°. Similarly, other stops (not shown) can be fastened to the apex cross beam 28 to limit the upward travel of the arms 36.

The support frame 18 includes a pair of weight rests 74 mounted to the vertical members 26 on the side of the support structure from which the arms 36 extend. The rests 74 are shown in greater detail in the enlarged view of FIG. 4. The rests 74 have a collar 76 that encircles the vertical members 26 and a retractable pin 78 that engages one of a series of holes 80, allowing vertical adjustment of the rest 74. A weight support 82 is connected to the collar 76 and projects from the collar 76 to provide a flat seat 84 for the bar 86 of a barbell or dumbbell, shown in phantom. An end stop 88 prevents the bar from rolling off the seat 84 and additionally provides a blunt end for inadvertent contact. The pin 78 is retracted against a compression spring 90 by a trigger 92 connected to the pin 78 and protected by a guard 94.

To provide additional safety for barbell users, the weight supports 82 of the weight rests 74 might be designed to extend even farther out away from the vertical members 26 of the frame 18. For example, the supports 82 might extend all the way out to the exerciser's shoulders. This design would permit an exerciser to place the barbell onto the weight rests 74 more easily in the event that this exerciser could not lift the weight, even with the full assistance from the spotter.

Figure 14:
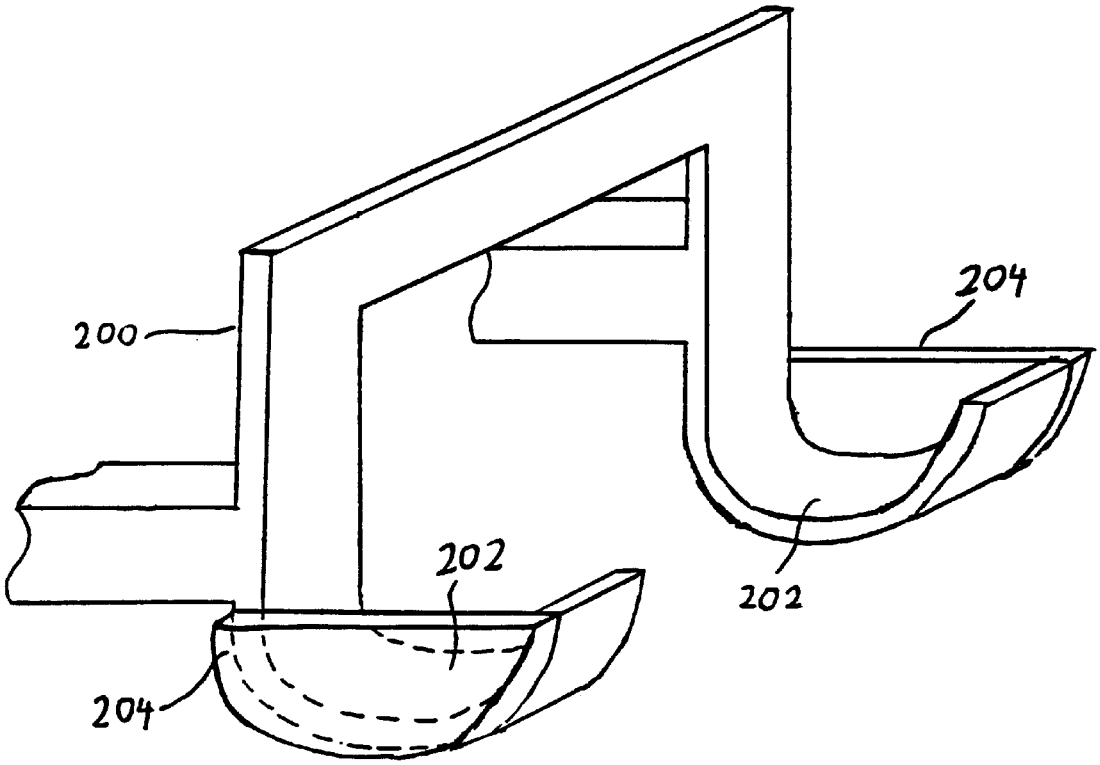
FIG. 14 is is an enlarged cross sectional view of an alternate design for a weight rest particularly suited for a dumbbell.

An alternate design of a weight rest suited specifically for dumbbells is shown in FIG. 14. This weight rest 200 attaches to the support frame 18 similarly to the weight rest 74 shown in FIG. 4. The weight rest 200 has seats 202 suited for resting a dumbbell thereon. A space between the seats 202 makes it easy for the exerciser to use the weight rest 200 reaching in from beneath it. Walls 204 prevent the dumbbell from falling out of the rest 200.

Figure 5:
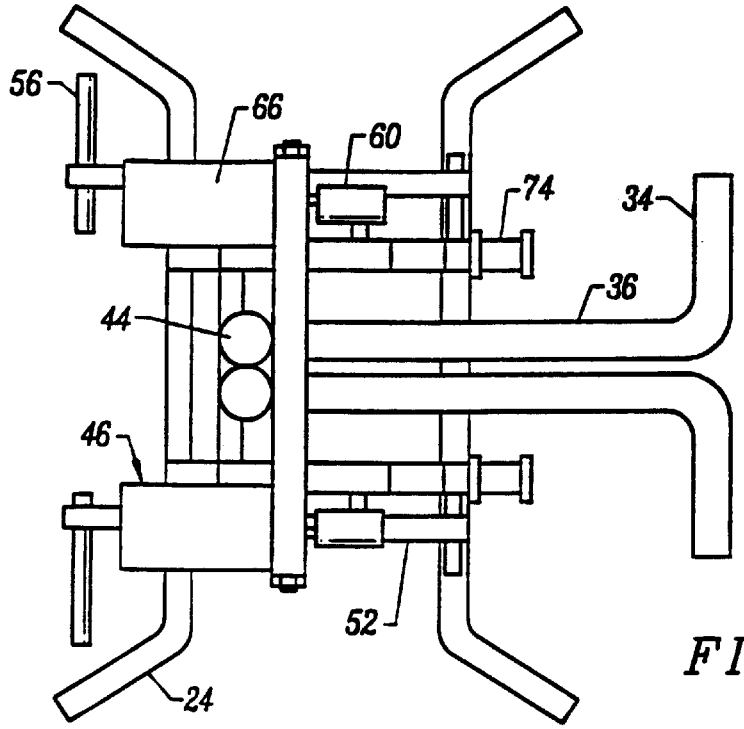
FIG. 5 is a top view of the weightlifting machine of FIG. 1.

The arrangement of the adjustment mechanism 46 to the cantilever arm 36 in each articulating structure 34 is shown in the top view of the spotter in FIG. 5.

Figure 6:
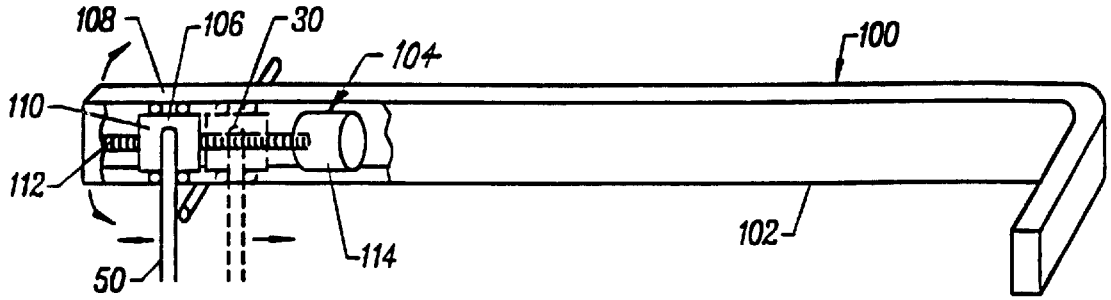
FIG. 6 is a schematic view of an alternate displacement unit for the weightlifting machine of FIG. 1.

Alternately, the cantilever arm 36 and the adjustment mechanism 46 can be combined into a single articulating unit as shown in the alternate embodiment of FIG. 6.

An alternate embodiment of the articulating unit 100 is shown schematically in FIG. 6. With the exception of the combined cantilever arm and remainder adjustment mechanism, forming the integrated articulating unit 100, the remainder of the apparatus is the same as that of the previously described embodiment. The cantilever arm 102 is a hollow box 104 that provides a housing for the adjustment mechanism 106. The cantilever arms 102 are spaced to allow connection of the elongated vertical links 50 to the adjustment mechanism 106. An extension 108 of the cantilever arms 102 on the opposite side of the pivot shaft 30 forms a housing for the movable internal carriage. The carriage 110 is threadably connected to a ball screw 112 in a manner similar to that shown in FIG. 3. A drive motor 114 is housed within the arm 102 and is connected to the adjustment screw 112 for displacement of the carriage 110 on activation of the motor in a forward or reverse direction. The articulating unit 100 is designed along with the rods 40, the ends 42, and their engaging means, to make the user experience no additional force upon the exercise weights aside from the force of weights themselves, until the user so desires, while the carriage 110 has its effective pivotal connection in a position proximate the axis of the pivot shaft 30.

Although only foot, hand, and head controls have been mentioned for activating the adjustment mechanisms, it is possible to use other means instead. One possibility is to make the adjustment mechanisms displace the effective pivotal connections after the weightlifter has completed a preprogrammed number of repetitions by incorporating switches into the cantilever arms for counting the number of repetitions. Another possibility is to make the adjustment mechanisms displace the effective pivotal connections once the user has been stationary for a preset length of time, since this is most likely when the user needs assistance.

For safety, the spotter can have an alarm that sounds when the effective pivotal connection is at the distal end of the adjustment mechanism and the maximum assistance is being provided. This noise would alert the weightlifter not to initiate any additional repetitions but instead to place the weight back onto its rests.

Because the spotter is designed to connect to a bar of weight, it is suited for use with traditional free weights, including primarily barbells and dumbbells. However, the spotter is also suited for use with other weightlifting machines that use similar bars, such as the "Smith" machines on which a bar is connected to vertical tracks.

While, in the foregoing, specific embodiments of the present invention have been set forth in considerable detail for the purpose of making a complete disclosure of the invention, it may be apparent to those skilled in the art that numerous changes can be made in such detail without departing from the spirit and principles of the invention.

I claim:

1. A mechanical weightlifting machine, comprising:

(i) a support structure having an elevated pivot with a pivot axis;

(ii) an articulating mechanism engaging the pivot, the articulating mechanism having at least one articulating structure, the articulating structure having a lever arm, wherein the lever arm has a distal end on one side of the pivot with a connection device from which a depending link member is suspended, the depending link member having and end with means for engaging a bar, the articulating structure having an adjustment mechanism with a displaceable connection device with an effective connection point locatable on the opposite side of the pivot, the displaceable connection device having a counterweight;

(iii) means for moving the displaceable connection device relative to the axis of the pivot wherein the leverage of said counterweight directed to said lever arm is adjusted;

(iv) actuation means for actuating said means for moving; and (v) a control device remote from the adjustment mechanism with control means for controlling said actuation means.

2. The mechanical weightlifting machine of claim 1 wherein the control device is positioned to be controlled by the weightlifter.

3. The mechanical weightlifting machine of claim 1 wherein the control means has displacement means for displacing the displaceable connection device by a specific amount within a limited range.

4. The mechanical weightlifting machine of claim 1 having the counterweight suspended from the displaceable connection device.

5. The mechanical weightlifting machine of claim 4 wherein the displaceable connection device has a depending vertical link with a distal end and a second lever arm having a first pivotal connection with the distal end of the depending link and a second pivotal connection with the support structure, wherein the depending vertical link and the second lever arm, together with the displaceable connection device, comprise the counterweight.

6. The mechanical weightlifting machine of claim 5 wherein the second lever arm has support means for supporting added counterweights to the second lever arm.

7. The mechanical weightlifting machine of claim 6 wherein the second lever arm has a first pivot end pivotally connected to the support structure and a second distal end, wherein the support means is located at the second distal end of the second lever arm.

8. The mechanical weightlifting machine of claim 1 wherein the depending link member is rigid having a universal joint connection to the distal end of the lever arm.

9. The mechanical weightlifting machine of claim 1 wherein the distal end of the lever arm has a shaft, the depending link member having a carriage for movement along said shaft, said carriage being free to rotate about the longitudinal axis of said shaft.

10. The mechanical weightlifting machine of claim 1 wherein the means for moving includes a screw threadably engaging the displaceable connection device.

11. The mechanical weightlifting machine of claim 10 wherein the actuation means includes a drive means for rotating the screw.

12. The mechanical weightlifting machine of claim 11 wherein the drive means comprises a reversible electric motor.

13. The mechanical weightlifting machine of claim 12 wherein the control means comprises an electronic controller circuitry associated with the electric motor for controlling the motor in response to control signals from the control device.

14. The mechanical weightlifting machine of claim 13 wherein the control means also has displacement means for rotating the motor by a specific amount within a limited range of rotation.

15. The mechanical weightlifting machine of claim 1 wherein the articulating mechanism has two articulating structures, each structure able to articulate independently.

16. A weightlifting machine which comprises:

(i) a supporting pivot having a pivot axis;

(ii) a lever arm having front and rear ends, the lever arm being journaled about said pivot axis intermediate said front and rear ends;

(iii) a weight supporting member having top and bottom ends, said top end being connected from the front end of said lever arm, and means at the bottom end of said weight supporting member for engaging a weight;

(iv) displaceable means for attaching a counterweight to a part of said lever arm;

(v) means for moving the location of said displaceable means for attaching along the lever arm between said pivot axis and said rear end; and (vi) an actuator for actuating said means for moving.

17. The mechanical weightlifting machine of claim 16, said displaceable means for attaching having an initial position proximate said pivot axis so that said counterweight exerts no torque about said pivot axis.

18. The mechanical weightlifting machine of claim 16, the bottom end of said weight supporting member being pivotally connected to means for engaging a weight, wherein said means for engaging has at least one degree of freedom relative to the weight supporting member.

19. The mechanical weightlifting machine of claim 18 wherein said means for engaging comprises at least three wheels about a generally symmetric polygonal shape, said polygonal shape having means for opening, receiving a weight, and securing itself around that weight.

20. The mechanical weightlifting machine of claim 19 having two polygonal shapes, the distance separating the shapes being adjustable, the dimensions of each polygonal shape also being adjustable.

* * * * *